United States Patent [19]

Heling

[11] 4,134,205

[45] Jan. 16, 1979

[54] VEGETABLE SLICER

[75] Inventor: Paul Heling, Solingen, Germany

[73] Assignee: Gerdes GmbH & Co., Schwelm, Germany

[21] Appl. No.: 850,801

[22] Filed: Nov. 11, 1977

[30] Foreign Application Priority Data

Nov. 12, 1976 [DE] Fed. Rep. of Germany ..... 2651568

[51] Int. Cl.[2] ..... B26B 3/00

[52] U.S. Cl. ..... 30/287; 30/303

[58] Field of Search ..... 30/287, 303

[56] References Cited

U.S. PATENT DOCUMENTS 489,647 1/1893 Coe ..... 30/303 X

FOREIGN PATENT DOCUMENTS 1013407 4/1952 France ..... 30/303

*Primary Examiner*—Al Lawrence Smith
*Assistant Examiner*—J. T. Zatarga
*Attorney, Agent, or Firm*—Montague & Ross

[57] ABSTRACT

A verticle spindle carrying cutting blades at its bottom end and a knob at its top is rotatably and slidably journaled in a neck of a housing positionable around vegetable or fruit to be sectioned. Rigid with the neck and coaxially surrounding the spindle are oppositely oriented upper and lower sets of sawteeth whose sloping flanks coact with respective groups of camming formations rigid with the spindle and disposed at the upper and lower ends thereof. These camming formations engage the associated sawteeth during the final phases of a cutting stroke and a return stroke of the spindle with a relative offset of a fraction of a pitch to impart to the spindle, knob and blades a stepped rotary unidirectional motion. The upper sawtooth flanks are more steeply inclined than the lower ones whereby the angle of rotation during a manual downstroke is less than that occurring during an upstroke brought about by the pressure of a restoring spring inserted between the knob and the housing.

10 Claims, 4 Drawing Figures

VEGETABLE SLICER

FIELD OF THE INVENTION

My present invention relates to a device, sometimes referred to as an onion slicer, designed to comminute or chop fruits, vegetables and the like.

BACKGROUND OF THE INVENTION

Conventional slicers of this type generally comprise a substantially cylindrical housing whose open bottom accommodates the object to be comminuted, such comminution being accomplished with one or more cutter blades vertically reciprocable within the housing. The cutter blades are usually mounted on a vertical stem or spindle terminating at its top in a manual actuator such as a handgrip or a knob which can be depressed against the force of a restoring spring.

For more effective slicing it is desirable to impart to the cutter blade or blades not only a vertical reciprocation but also a rotary motion. Various means for driving the cutter with a stepwise rotary movement have already been proposed for this purpose. Some of these stepping mechanisms, located in the actuator, are quite complex and correspondingly expensive. In certain cases the actuator must be quickly released at the end of a downstroke lest the vertical reciprocation be translated into an oscillating rather than a progressive rotary motion.

OBJECT OF THE INVENTION

The object of my present invention, therefore, is to provide an improved vegetable slicer of this general type which is of simple construction, has no moving parts other than the assembly of cutter, spindle and actuator, and is easy to operate.

SUMMARY OF THE INVENTION

In accordance with my present invention, I provide such a device with first and second driving means for advancing the movable assembly within its housing by an initial fraction of a rotary step upon manual depression of the actuator against the force of a restoring spring and for advancing that assembly by a complementary terminal fraction of such a rotary step upon subsequent re-elevation of the assembly to its normal position by the spring force. The first driving means includes first camming formations on the upper part of the movable assembly, preferably near the top of the spindle which is guided in a tubular neck of the housing, and first coacting formations on the housing; the second driving means includes second camming formations on a lower part of the assembly, preferably on a support for the cutter blade or blades detachably secured to the spindle, and second coacting formations on the housing.

Advantageously, either the camming formations or the coacting formations of each driving means comprises an annular set of sawteeth. In the preferred embodiment described hereinafter the sawteeth constitute the coacting formations and are disposed in back-to-back relationship in annular recesses on an inner surface of the tubular housing neck.

Pursuant to another important feature of my invention, the upper set of sawteeth has more steeply inclined flanks than the lower set whereby the initial fraction of a rotary step, brought about by the downstroke of an actuator, is smaller than its terminal fraction, occurring during an upstroke. This is advantageous since rotation on the downstroke occurs under manual pressure against the resistance of the object being sliced whereas the upstroke usually takes place under spring pressure with the palm of the user resting but lightly on the knob.

BRIEF DESCRIPTION OF THE DRAWING

The above and other features of my invention will now be described in detail with reference to the accompanying drawing in which.

SPECIFIC DESCRIPTION

Figure 1:
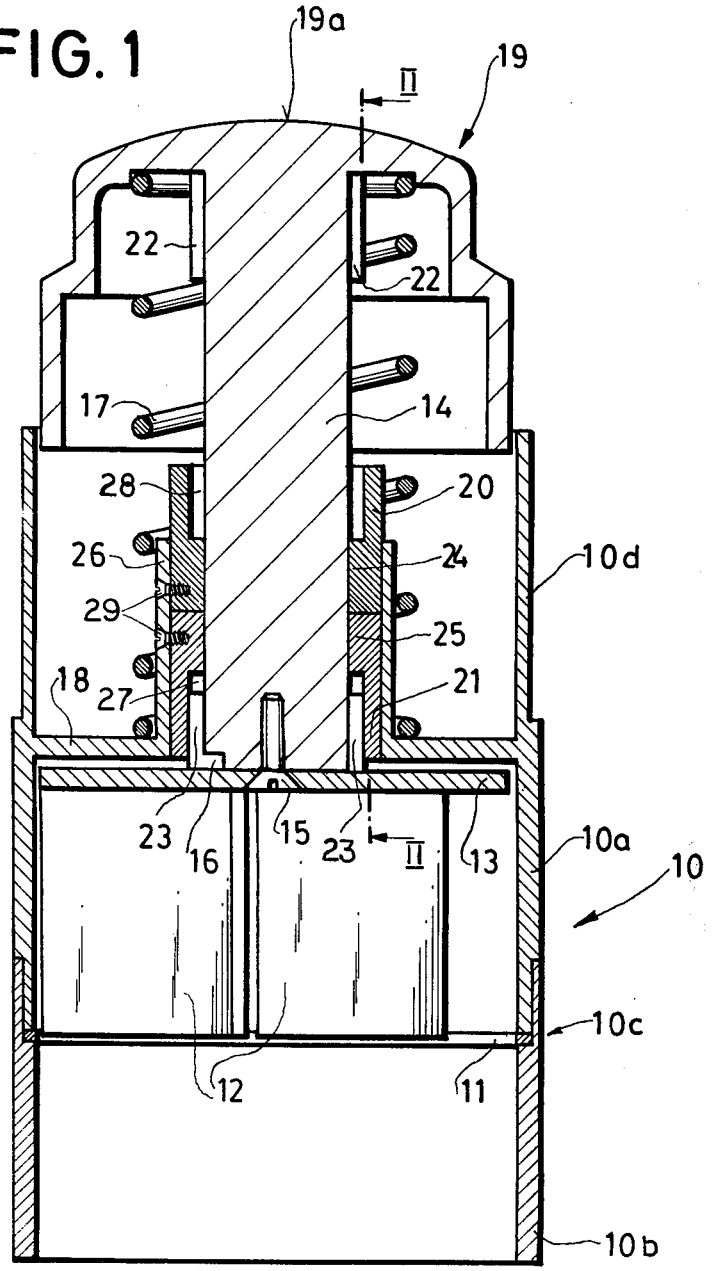
FIG. 1 is an axial sectional view of my improved vegetable slicer.

As illustrated in FIG. 1, a vegetable slicer according to my invention comprises a cylindrical housing 10 positionable around a vegetable or fruit to be sectioned. The housing includes a lower portion or skirt **10*b* detachably fitted, for easy cleaning, to an upper portion 10*a* which is bounded at its top by a transverse wall or partition 18 provided with two coaxial collars 10*d*, 26. A spindle 14 attached at one end to a blade carrier 13 and integral at an opposite end with a bell-shaped knob 19 is rotatably and slidably guided in two sleeves 24 and 25 press-fitted into collar 26 and thus rigid with housing 10. Setscrews 29 may be provided, as shown, for a more positive coupling therebetween. A helical spring 17 is coiled around spindle 14 and held in compression between knob 19 and housing wall 18**.

Figure 4:
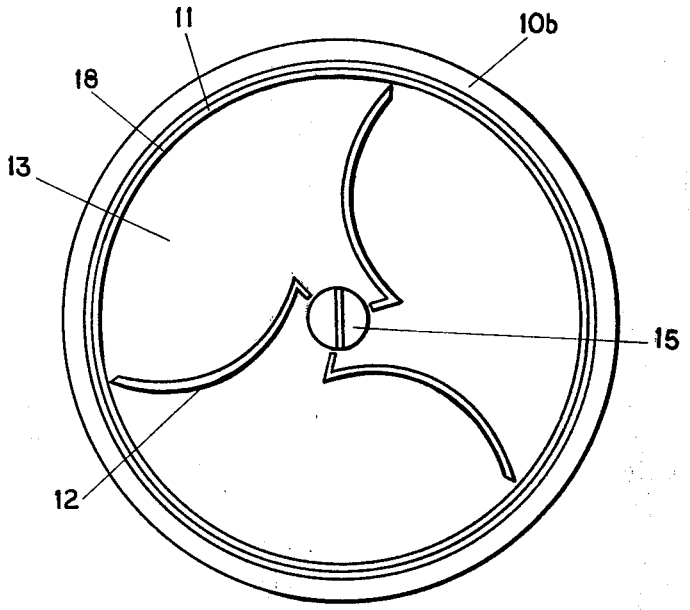
FIG. 4 is a bottom view of the device shown in FIG. 1.

The blade carrier 13 is a circular disk secured to spindle 14 by a central screw 15 and by a key 16 projecting into a complementary recess in the spindle for positively inhibiting relative rotational movement of the spindle and the carrier. As illustrated in FIG. 4, a cutter here consisting of three curved blades 12 spaced 120° apart is mounted in the underside of disk 13. Also shown in FIG. 4 is an annular wiper 11 held at the junction **10*c* between skirt 10*b* and housing body 10*a* for stripping the skins of shells off fruits or vegetables being chopped. The bottom edges of blades 12 lie substantially at the level of wiper 11 in the position of FIG. 1**.

Figure 2:
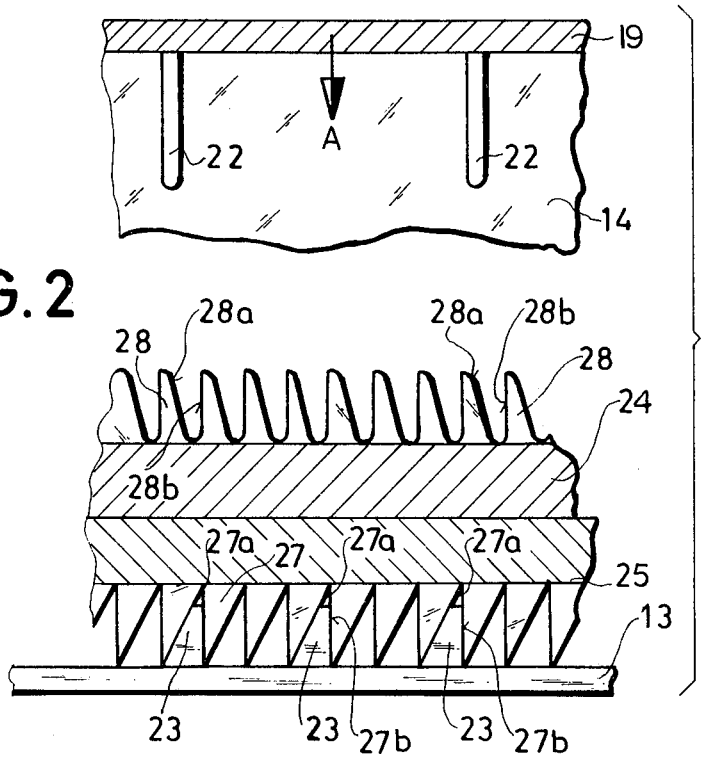
FIG. 2 is a fragmentary developed view of the driving formations of the slicer in its normal position.
Figure 3:
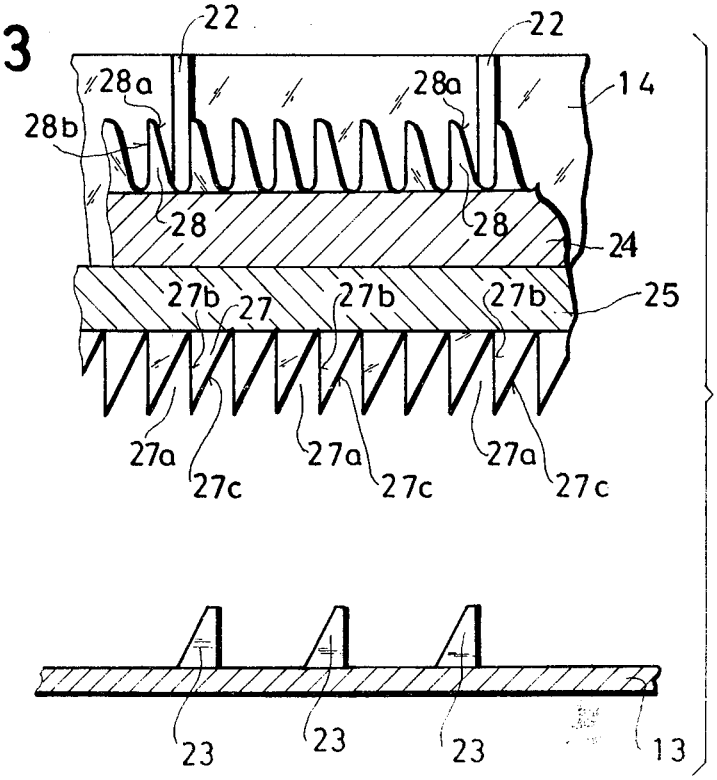
FIG. 3 is a view similar to FIG. 2, showing these formations at the end of a working stroke.

Sleeves 24 and 25 have extensions 20, 21 of reduced wall thickness forming internal recesses with rings of sawteeth 28 and 27 respectively coacting with a pair of vertical camming ribs 22 integral with spindle 14 and three triangular camming lugs 23 integral with blade carrier 13 to produce a stepwise rotation of the spindle upon the depression of handgrip 19. Sawteeth 27 and 28 are illustrated in a developed view in FIG. 2, their positions relative to camming formations 22, 23 corresponding to that shown in FIG. 1 with assembly 12, 14, 19 elevated above the surface of a table top or other supporting surface on which the slicer is resting. Each tooth 27, 28 is provided with an inclined flank **27*c*, 28 and with a vertical flank 27*b*, 28*b*. In FIG. 2 the lugs 23 engage in triangular gaps 27*a* between teeth 27 of the lower sleeve 25. As downward pressure is applied to knob 19, e.g. by pushing with the palm on its upper surface 19*a*, spindle 14 with its integral camming ribs 22 moves axially downward within neck 24–26, as indicated by an arrow A. Camming lugs 23 slide out of engagement with teeth 27, restoring spring 17 becomes more compressed and knob 19 moves deeper into the surrounding collar 10***d*. Near the end of a downward stroke of spindle 14, ribs 22 engage the inclined flanks 28*a* of a pair of upwardly projecting teeth 28 and slide down their surfaces until stopped by a pair of vertical flanks 28*b*, as illustrated in FIG. 3, thereby producing an incremental rotary motion of spindle 14 along with carrier 13 and blades 12. The lugs 23, being rigid with carrier 13, also experience an angular displacement so that their vertical flanks are angularly offset by a fraction of a pitch from vertical flanks 27*b* of downwardly projecting teeth 27 previously aligned therewith. Upon the relaxation of downward pressure on knob 19, compressed spring 17 pushes the knob upward, thereby disengaging ribs 22 and teeth 28. At the end of an upstroke of spindle 14, the lugs 23 slide against the inclined flanks 27*c* of three lower teeth 27 to produce another short rotational motion of the spindle, whereby the ribs 22 are shifted out of alignment with the vertical flanks 28*b* of the upper teeth 28. The lugs 23 are now, at the end of an upstroke, re-engaged with the teeth of the lower sleeve 25 (as illustrated in FIG. 2) but, having shifted one step to the right, are seated in gaps 27*a* adjacent those previously occupied. It is seen that, with repeated depression of the knob 19 a number of times equal to the number of sawteeth in each sleeve 24, 25, the movable assembly 12, 14, 19 will have completed one full revolution.

I prefer to make the lugs 23 integral with blade carrier 13 as this permits the removal and reinsertion of spindle 14 through sleeves 24 and 25. However, these lugs could also be solid with the lower end of the spindle. Furthermore, sleeves 24 and 25 need not be individually formed but may be consolidated with collar 26 into a unitary neck integral with housing 10, the housing being then preferably molded from synthetic resin.

As shown in FIGS. 2 and 3, the flanks 28*a* of the upper teeth are inclined to a lesser extent than the flanks 27*c* of the lower teeth. Thus, a greater portion of an incremental rotational step is imparted during the return stroke of spindle 14 than during the downward cutting stroke when manual pressure is being applied to knob surface 19*a*.

It should be noted that the desired rotary advance of assembly 12, 4, 19 relative to housing 10 in two steps — at the end of consecutive downward and upward strokes — can be brought about by different driving formations, e.g. with rings of sawteeth at the upper and lower extremities of spindle 14 and coacting ribs, lugs or teeth on the housing neck 24–26 or on some other part of the housing. In all instances, however, the upper formations and the lower formations should operate with an effective relative offset amounting to a fraction of a pitch so that neither the upstroke nor the downstroke is blocked by these formations. The use of two sets of sawteeth with aligned axially extending (i.e. vertical) flanks 27*b*, 28*b* is particularly advantageous in that it simplifies the visual determination of that offset and possible adjustment thereof, e.g. by the insertion of shims between key 16 and one or the other sidewall of the recess in which it is received. Collar 10*d*, while not essential, is useful in protecting the camming mechanism against contamination by fruit or vegetable cuttings, as does the wiper 11 whose inner diameter is not greater than the diameter of disk 13.

In principle, a single camming rib 22 or camming lug 23 would suffice to step the rotary assembly. The use of multiple formations angularly equispaced about the spindle axis, however, assures a more balanced stress distribution and thus helps prevent jamming. The several cutter blades 12 could also be replaced by a single, preferably symmetrical blade.

I claim:

1. A vegetable slicer comprising:

a downwardly open generally cylindrical housing provided with a tubular neck rising from a transverse wall thereof;

a vertical spindle rotatably and slidably guided in said neck, said spindle being provided at its upper end with a manual actuator;

cutter means within said housing secured to the lower end of said spindle beneath said wall, said cutter means forming with said spindle and said actuator an assembly movable in said housing;

spring means between said wall and said actuator tending to maintain said assembly in an elevated position with said cutter means raised above a surface supporting said housing;

first driving means including first camming formations on an upper part of said assembly and first coacting formations on said housing for advancing said assembly by an initial fraction of a rotary step upon manual depression of said actuator against the force of said spring means; and second driving means including second camming formations on a lower part of said assembly and second coacting formations on said housing for advancing said assembly by a complementary terminal fraction of a rotary step upon restoration of said assembly to said elevated position by said spring means.

2. A vegetable slicer as defined in claim 1 wherein said first and second driving means include oppositely oriented upper and lower annular sets of sawteeth.

3. A vegetable slicer as defined in claim 2 wherein said upper set of sawteeth has more steeply inclined flanks than said lower set of sawteeth whereby said initial fraction is smaller than said terminal fraction.

4. A vegetable slicer as defined in claim 3 wherein said upper and lower sets of sawteeth constitute said first and second coacting formations and are disposed in back-to-back relationship in annular recesses on an inner surface of said neck.

5. A vegetable slicer as defined in claim 4 wherein said first camming formations are disposed on the top end of said spindle just below said actuator, said second camming formations being disposed at the bottom of said spindle just above said cutter means.

6. A vegetable slicer as defined in claim 5 wherein said cutter means comprises a supporting disk detachably secured to the spindle bottom, said second camming formations rising from said supporting disk.

7. The combination defined in claim 6 wherein said first camming formations are vertical ribs integral with said spindle, said second camming formations being upstanding generally triangular lugs integral with said supporting disk.

8. The combination defined in claim 4 wherein said upper and lower sets of sawteeth are of identical pitch and have aligned vertical flanks, said first and second camming formations being relatively offset by a fraction of a pitch.

9. The combination defined in claim 1 wherein said spring means comprises a coil spring surrounding said neck, said actuator being a knob, said housing having an upstanding collar embracing said spring and part of said knob.

10. The combination defined in claim 1, further comprising wiper means in said housing engageable by said cutter means, the latter having a bottom edge located substantially at the level of said wiper means in said elevated position.

* * * * *